US005612063A

United States Patent [19]

Schilo et al.

[11] Patent Number: 5,612,063

[45] Date of Patent: Mar. 18, 1997

[54] APPARATUS FOR MELT SPINNING MULTIFILAMENT YARNS

[75] Inventors: Diederich Schilo, Klingenberg; Wolfgang Peschke, Obernburg, both of Germany

[73] Assignee: Akzo N.V., Netherlands

[21] Appl. No.: 939,936

[22] Filed: Sep. 2, 1992

[30] Foreign Application Priority Data

| | | | |
|---|---|---|---|
| Sep. 6, 1991 | [DE] | Germany | 41 29 521.8 |
| Jan. 17, 1992 | [DE] | Germany | 42 01 119.1 |
| Mar. 6, 1992 | [DE] | Germany | 42 07 095.3 |

[51] Int. Cl.[6] ..... B29C 47/88; D01D 5/088

[52] U.S. Cl. ..... 425/72.2; 264/177.19; 264/211.12; 264/211.14; 264/237; 425/378.2; 425/382.2; 425/464

[58] Field of Search ..... 425/72.2, 378.2, 425/382.2, 464, 445; 264/176.1, 211.12, 211.14, 237, 177.19, 177.17

[56] References Cited

U.S. PATENT DOCUMENTS

| | | | |
|---|---|---|---|
| 2,252,684 | 8/1941 | Babcock | 425/72.2 |
| 3,067,458 | 12/1962 | Dauchert . | |
| 3,611,485 | 10/1971 | Leybourne et al. | 425/445 |
| 4,195,051 | 3/1980 | Frankfort et al. | 264/211.14 |
| 4,568,506 | 2/1986 | Kiriyama et al. | 264/211.14 |
| 4,702,871 | 10/1987 | Hasegawa et al. | 264/211.14 |
| 4,712,988 | 12/1987 | Broaddus et al. . | |
| 4,943,220 | 7/1990 | Fourne . | |
| 5,034,182 | 7/1991 | Sze et al. | 264/211.14 |
| 5,141,700 | 8/1992 | Sze | 264/211.14 |
| 5,219,582 | 6/1993 | Anderson et al. . | |
| 5,234,327 | 8/1993 | Martin | 264/211.14 |
| 5,340,517 | 8/1994 | Koschinek et al. . | |
| 5,360,589 | 11/1994 | Wandel et al. | 425/72.2 |

FOREIGN PATENT DOCUMENTS

| | | | |
|---|---|---|---|
| 0056963 | 8/1982 | European Pat. Off. . | |
| 0095712 | 12/1983 | European Pat. Off. . | |
| 0117215 | 8/1984 | European Pat. Off. . | |
| 0244216 | 11/1987 | European Pat. Off. . | |
| 0455897 | 11/1991 | European Pat. Off. . | |
| 580977 | 2/1994 | European Pat. Off. . | |
| 1914556 | 3/1970 | Germany . | |
| 2212011 | 11/1972 | Germany . | |
| 143527 | 8/1980 | Germany . | |
| 3941824 | 6/1991 | Germany . | |
| 43-19609 | 8/1968 | Japan | 425/72.2 |
| 59-94614 | 5/1984 | Japan | 264/211.14 |
| 61-47817 | 3/1986 | Japan | 264/211.14 |
| 62-15319 | 1/1987 | Japan | 264/211.14 |
| 63-99312 | 4/1988 | Japan . | |
| 2-269807 | 11/1990 | Japan | 264/211.14 |
| 467348 | 2/1969 | Switzerland . | |
| 1067098 | 1/1984 | U.S.S.R. . | |
| 774814 | 5/1957 | United Kingdom . | |
| 1088240 | 10/1967 | United Kingdom . | |
| 90/02222 | 3/1990 | WIPO . | |
| WO93/19229 | 3/1993 | WIPO . | |

*Primary Examiner*—Jay H. Woo
*Assistant Examiner*—Joseph Leyson
*Attorney, Agent, or Firm*—Oliff & Berridge

[57] ABSTRACT

An apparatus for melt spinning multifilament yarns from fiber-forming polymers at wind-up speeds of at least 2,000 m/min, includes a spinnerette, a porous tube for solidifying the filaments, a convergence element for the filaments and a wind-up device. The apparatus further includes, at least between the spinnerette and the convergence element, an essentially vertical spinline. The porous tube is open in the spinning direction and concentric relative to the spinline.

23 Claims, 5 Drawing Sheets

APPARATUS FOR MELT SPINNING MULTIFILAMENT YARNS

BACKGROUND OF THE INVENTION

The present invention relates to an apparatus for melt spinning multifilament yarns from fiber-forming polymers at wind-up speeds of at least 2,000 m/min. The apparatus includes a spinnerette, a cooling means for solidifying the filaments, a convergence element for the filaments and a wind-up means. The apparatus also includes an essentially vertical spinline at least between the spinnerette and the first convergence element. The invention also relates to the use of this apparatus for manufacturing polyester filament yarns.

In the manufacture of multifilament yarns from fiber-forming polymers, manufacturing costs are crucially affected by the wind-up speed. Wind-up speeds of 3,500 to about 5,000 m/min are common today, while wind-up speeds of more than 5,000 m/min to about 12,000 m/min are also known. At these high wind-up speeds, in particular at wind-up speeds above 5,000 m/min, it is known from prior art manufacturing processes that the design of the apparatus used to perform the process plays an ever greater part in the manufacture of multifilament yarns, whereas purely process features are becoming increasingly less significant.

For instance, EP-A-56,963 describes a process for manufacturing a polyester fiber using a wind-up speed of at least 5,000 m/min, where the extruded filaments are initially guided through a heating zone at least 50 mm in length and then directly into a suction device before they are wound up. As is discernible from the drawing, the apparatus described for carrying out this process has a notably simple design.

Further simplification of this known apparatus is revealed in EP-A-95,712, where the heating zone is initially followed by a cooling part for solidifying filaments and then by a convergence element for the filaments, after which the multifilament yarn is wound up. Essential parts of this apparatus are the heating zone below the spinnerette, the location for bundling the filaments and the wind-up speed of 7,000 m/min or more. A similar apparatus is described in EP-A-117,215, where not only the location for converging the filaments but also the distance between the spinnerette and the wind-up means are specified as essential features.

Although the descriptions of the aforementioned structural elements of the apparatus mention that a cooling part is necessary for solidifying the filaments, they do not provide any disclosure concerning the design of the cooling part.

EP-A-244,216 observes, in relation to the design of the cooling means, that the cooling air should be supplied under controlled conditions radially from out to in via a wire mesh cylinder. This apparatus additionally requires a sharp reduction in the exit cross-section of the wire mesh cylinder to a narrow tube, causing the start-up of spinning to be very complicated.

In WO 90/02222, the filament yarns are spun into a closed spin chamber. If this spin chamber is used as cooling means, cooling air is sucked off via an injector. To start up spinning, it is initially necessary to remove the injector, similarly causing the start-up of spinning to be very complicated.

SUMMARY OF THE INVENTION

Accordingly, it is an object of the present invention to provide an apparatus for melt spinning multifilament yarns that is simple in structure and suitable for manufacturing multifilament yarns from fiber-forming polymers at wind-up speeds of at least 2,000 m/min and preferably at least 5,000 m/min, where the start-up of spinning is simple to accomplish and the use of which for manufacturing multifilament yarns is particularly versatile.

This and other objects are achieved when the cooling part is a porous tube which is open in the spinning direction and concentric relative to the spinline. The apparatus includes a spinnerette, the porous tube for solidifying the filaments, a convergence element for converging the filaments to yarn, and a wind-up for winding the yarn. An essentially vertical spinline is disposed at least between the spinnerette and the convergence element, the porous tube being open in a spinning direction and concentric relative to the spin-line. Air for cooling the filaments is drawn through the porous tube solely by the filaments themselves due to the wind up speed of at least 2000 m/min.

In a preferred embodiment, the structure is suitable for manufacturing multifilament yarns from fiber-forming polymers at wind-up speeds up to at least 10,000 m/min.

BRIEF DESCRIPTION OF THE DRAWING

Other objects will become apparent in light of the following detailed description of preferred embodiments when taken in conjunction with the accompanying drawing, in which.

DETAILED DESCRIPTION OF PREFERRED EMBODIMENTS

Figure 1:
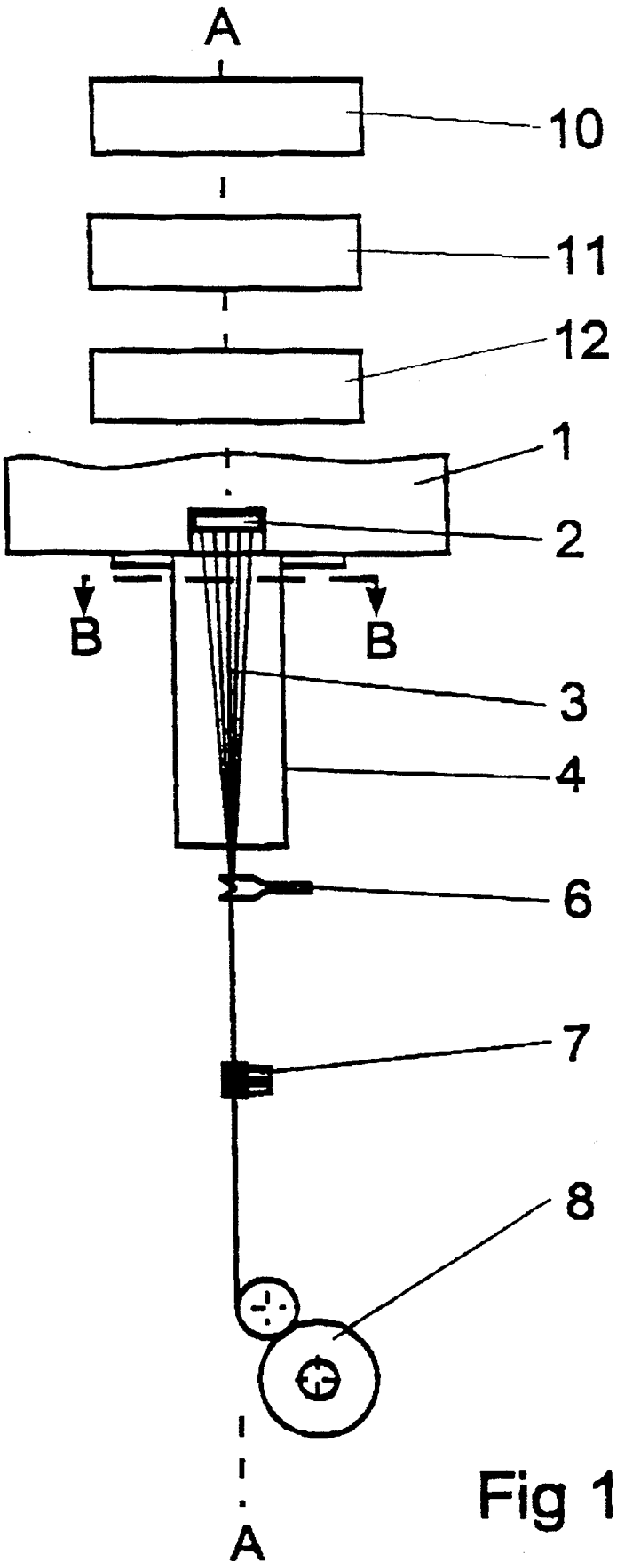
FIG. 1 is a front view of a structure of the present invention.
Figure 2:
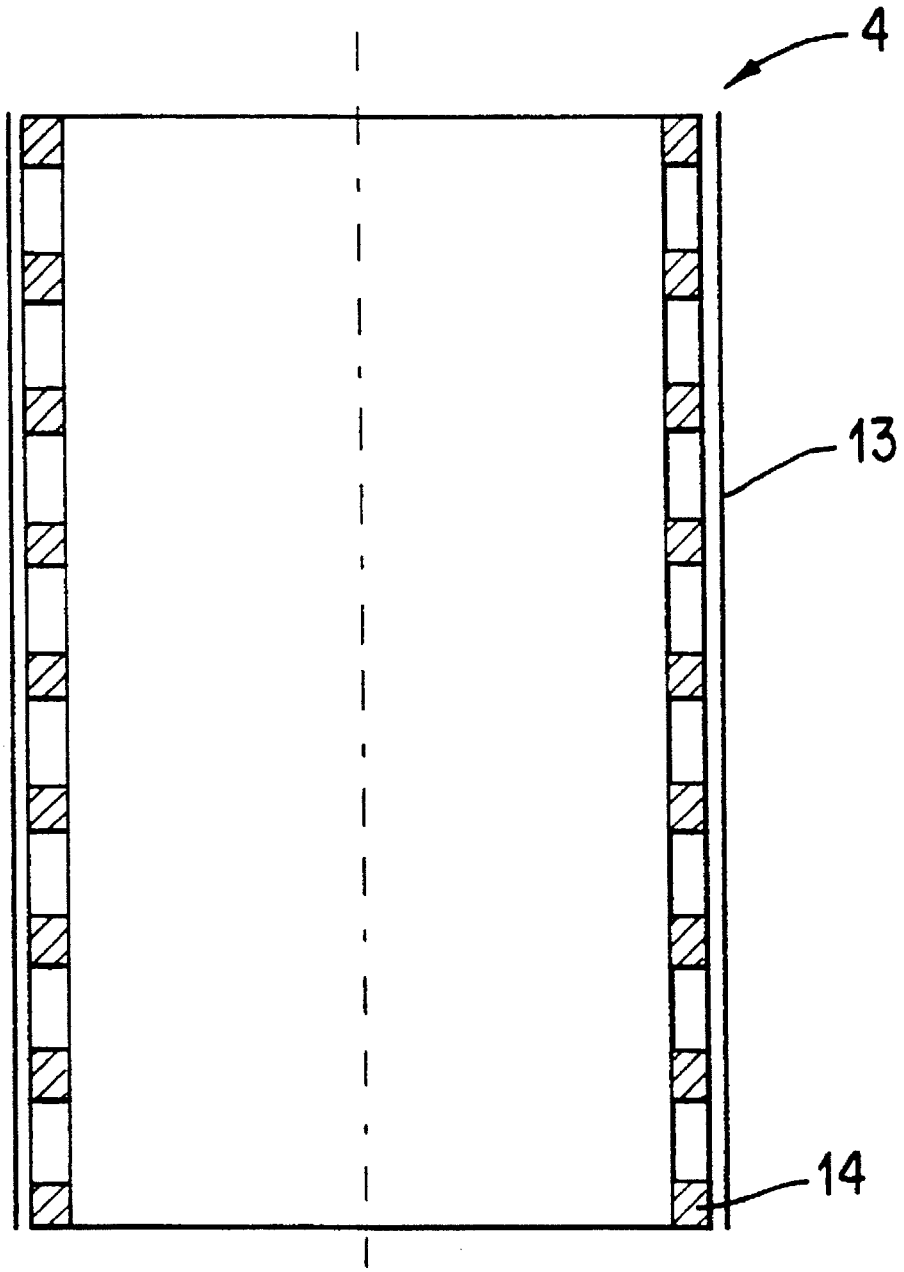
FIG. 2 illustrates a metal sieve with a perforated metal sheet support.
Figure 3:
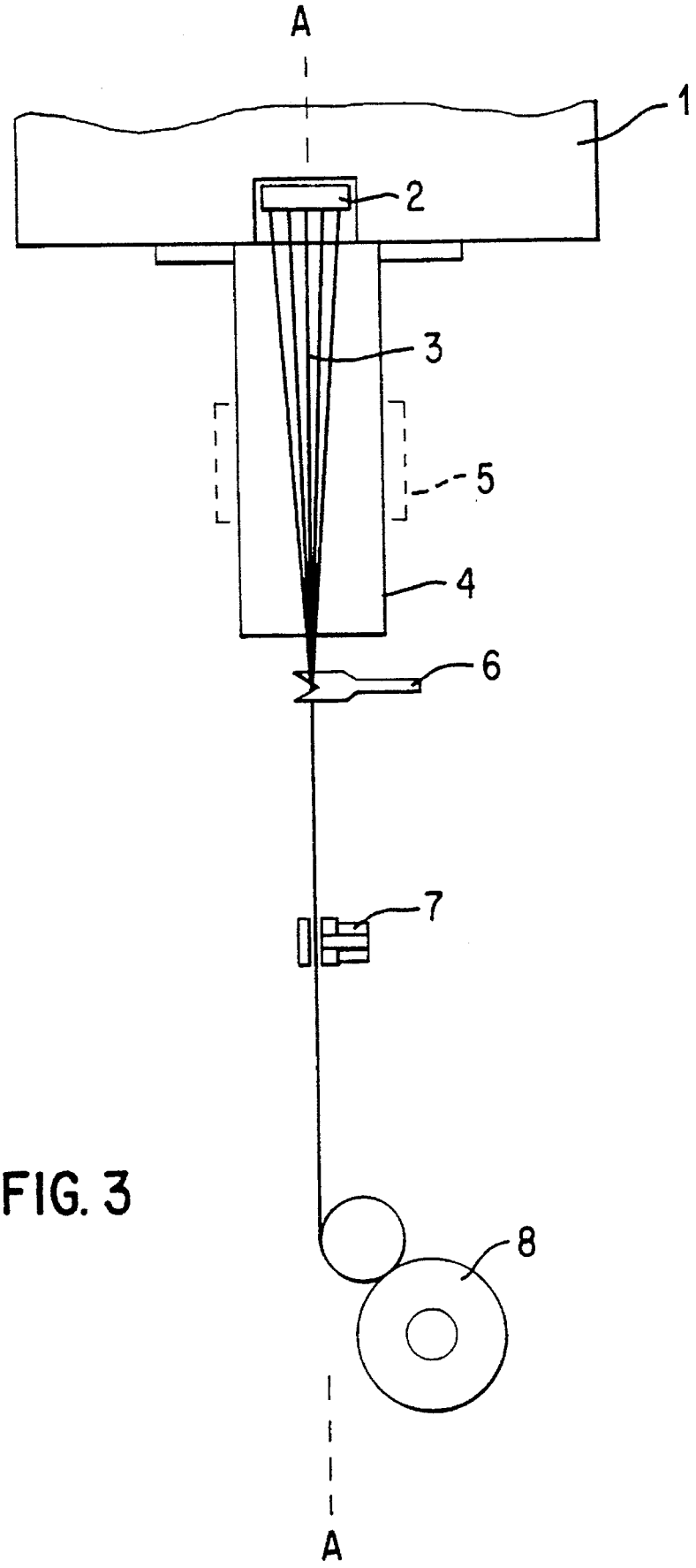
FIG. 3 is a front view of an alternate structure of the present invention.

The apparatus of the invention will now be more particularly described with reference to the figure.

A spin pack 1 contains a spinnerette 2. Spinnerette 2 extrudes a plurality of filaments 3, which enter a porous tube 4 directly underneath the spinnerette. On leaving porous tube 4, the filaments pass through a convergence element 6—a yarn guide in the depicted case—to form a yarn. For better cohesion of the filaments within the yarn, an air-jet entangler 7 can be installed upstream of wind-up means 8. Air-jet entangler 7 advantageously takes the form of parallel plate nozzles, which are preferably operated at pressures of 1.5 to 8 bar, the pressure chosen increasing with the spinning speed. Along the spinline A—A, there may additionally be arranged yarn monitoring systems such as, for example, brokenfilament detectors and cutters (not shown).

The manufacture of multifilament yarns, especially at very high wind-up speeds, is particularly successful without an active supply of a cooling medium. It is surprisingly completely sufficient for the spinnerette to be followed by a porous tube which is open in the spinning direction without having to provide further attachments to the tube for carrying a cooling medium such as air or an air stream, or for sealing off from the outside. It is even completely sufficient for the air which surrounds the porous tube to be at room temperature, so that the apparatus of the invention is particularly economical to operate. Additionally, it is necessary simply to arrange the porous tube concentrically relative to the spinline. A length of 200 to 1,800 mm for the porous tube has been found to be favorable.

Using spinning apparatus of the type defined, it is possible to process virtually any spinnable polymer into multifilament yarn. Especially polyethylene terephthalate, polyamide, nylon-6, nylon-6,6, copolymers thereof and mixtures of these polymers are best suited for spinning by the apparatus of the invention.

Owing to the simple construction of the cooling means of the apparatus of the invention, it is also very simple to adapt the length of the tube to optimal spinning in each case. A set of porous tubes of different lengths within the range from 200 to 1,800 mm is provided in which the lengths of the individual tubes differ, for example, by increments of about 100 mm. However, for further simplification, the porous tube may also have a telescopic structure. To manufacture fully oriented yarns (FOYs), which are wound up at a speed of 5,000 to 10,000 m/min, it is particularly advantageous for the porous tube to be from 200 to 1,200 mm in length, whereas partially oriented yarns (POYs), which in general are wound up at 2,000 to 5,000 m/min, will be produced using a porous tube from 900 to 1,800 mm in length. To manufacture thicker filaments or filament yarns having a higher total linear density, the porous tube used should have a length at the upper end of the above-specified length range.

It is fully sufficient for the porous tube to have a constant cross-section in its longitudinal direction. This constant cross-section makes the start-up of spinning with the apparatus of the present invention particularly simple to accomplish, since the filaments pass through the tubular zone in free-fall and can be collected underneath the tube. However, it is also possible to use other tube shapes, for example frustoconical tubes.

The cooling air required for solidifying the filaments is aspirated through the porous tube by the filaments themselves, owing to their high speed. Pretreatment of the cooling air is not necessary. Especially in the case of polyester filament yarns, the usual atmospheric conditions in the vicinity of the apparatus of the invention are sufficient. As a result, the operating personnel can work on the apparatus of the invention under comfortable conditions. Compared with known apparatuses, the apparatus of the present invention requires less space, since no ducts are necessary for supplying conditioned air. At the start-up of spinning, less waste results. The apparatus is also notable for particularly low energy requirements, since no conditioning of the cooling air and no further means for influencing the temperature of the yarn are required until the yarn is wound up.

It is an advantage for the spinline between spinnerette and wind-up to be essentially vertical, especially at very high spinning speeds.

In the apparatus of the present invention, it is particularly advantageous for the porous tube to be cylindrical, in which case the cross-section of the cylinder may have virtually any widely-used geometric shape such as, for example, that of a circle, ellipse, octagon or hexagon. It is particularly advantageous for the inner cross-section of the porous tube to have at least approximately the same geometrical shape as the outer contour of the filament bundle. This results in a particularly uniform solidification of the individual filaments. It is preferable for the distance between the outer contour of the filament bundle and the inner surface of the porous tube, at the entry cross-section, to be selected in such a way that contact with the tube wall is avoided. A suitable range for the distance between filament bundle contour and tube wall is 5 to 40 mm, the distance being shorter, for example 5 to 20 mm, in the case of shorter porous tubes and greater, for example 20 to 30 mm, optionally up to 40 mm, in the case of longer tubes.

In the choice of material for the porous tube, it is merely necessary to ensure that the porous tube can be attached directly to the spinnerette and thus that it will not soften at the temperatures prevailing in the spinnerette. Suitable materials for this purpose are for example metals, especially steel. The porous tube should adjoin the spinnerette, the spin pack or a cooling delay means interposed between spinnerette and porous tube. The cooling delay means would be disposed in such a way that, in the region of the porous tube, air ingress is possible only via the pore system of the porous tube, such that uncontrolled inflow of cooling medium into the region underneath the spinnerette is effectively avoided.

The porosity of the tube can be achieved, in the simplest case, with a perforated tube or else with sintered metals. In principle, any porous tube is suitable whose porosity will produce a pressure drop of about 3 to 150 Pa, and preferably of about 10 Pa, at an air flow rate of 1 m/s. However, it is particularly advantageous for the porous tube to be formed of a metal sieve 13, in which case a metal sieve of 60 mesh is most suitable. To stabilize the metal sieve 13, an additional tube 14 of perforated metal can be arranged therein.

Figure 5:
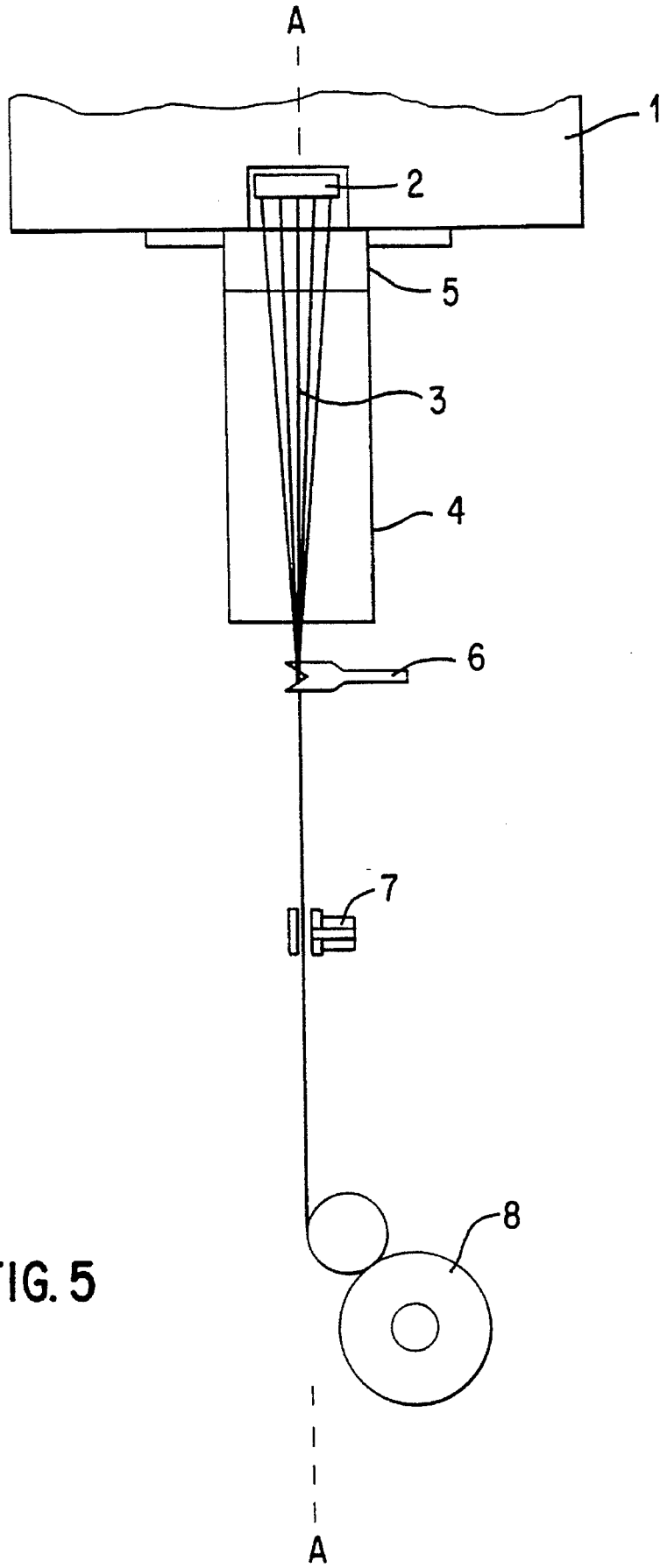
FIG. 5 illustrates an embodiment of the invention wherein a device for inhibiting cooling of the filaments is provided between a spinnerette and a porous tube.

The porous tube can be connected directly to the spinnerette. However, it is also possible to connect a device 5 (as shown in FIG. 5) up to 300 mm in length between the spinnerette and the porous tube, adjoined by the porous tube, which will inhibit the cooling of the filaments.

Inhibition of filament cooling can be effected, for example, as a result of the fact that the means for inhibiting the cooling comprises a hot airstream enveloping the filaments. This ensures a uniform delayed cooling of the filaments. Advantageous results are achieved when the hot air jacket has a temperature that corresponds approximately to the temperature of the spinnerette. The hot airstream may be up to 300 mm in length.

Figure 4:
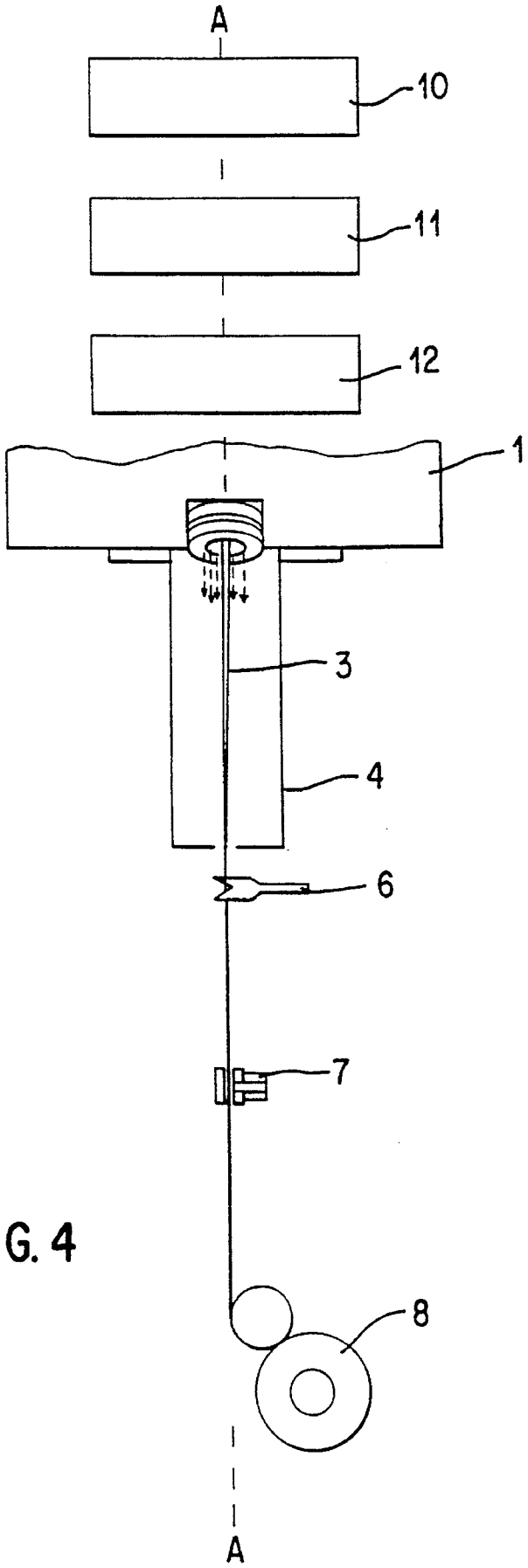
FIG. 4 illustrates an embodiment of the invention wherein a hot airstream envelops the filaments.

The hot air jacket is particularly useful in conjunction with a multiple spinnerette where the melt is extruded in the center. A hot airstream, which envelops the filaments, travels through a plurality of orifices arranged concentrically around the center of the spinnerette. It is particularly advantageous for the orifice, arranged concentrically around the center, to be an annular gap. The use of such spinneretres for the delayed cooling of filaments is known per se from DE-A-3 941 824 and EP-A-0 455 897 as illustrated in FIG. 4. Inhibition of filament cooling can also be achieved in a particularly simple manner when the means for inhibiting the cooling of filaments 5 is a heated tube or in particular an unheated tube (as shown in FIG. 5). This means for inhibiting the cooling of filaments 5 is particularly simple when a part, up to 300 mm in length, of the end of the porous tube facing the spinnerette is covered over a length of up to 300 mm (as shown in phantom FIG. 1). The covered part is preferably situated directly underneath the spinnerette. Inhibited filament cooling results in delayed cooling of the filaments. This provides for smooth processing, particularly at low filament linear densities.

However, to manufacture thicker filaments, or if relatively long porous tubes are used, the covering of the porous tube should be situated at a distance of 200 to 300 mm away from the spinnerette.

The convergence element of the present invention is preferably situated at a distance of 400 to 2,200 mm away from the spinnerette, but at least about 100 mm below the porous tube. In the simplest case, the convergence element can be a yarn guide; however, it is particularly advantageous for the convergence element to be a conventional spin finish applicator.

The structure of the present invention also makes it possible for the spinnerette and wind-up to be a particularly large distance apart, for example, up to 9,000 mm. The wind-up means is preferably situated about 2,000 to 4,000 mm underneath the spinnerette. At spinning speeds of 6,000 m/min or more for manufacturing FOY, the distance between the spinnerette and wind-up is most suitably in the range of about 2,000 to 3,500 mm, preferably 2,400 mm, and in the case of spinning speeds of 2,000 to 5,000 m/min for manufacturing POY, the range is most suitably about 2,500 to 3,500 mm, preferably 3,000 mm. For the manufacture of yarns having a filament linear density of more than 3 dtex or a total linear density of more than 100 dtex, this distance should be extended to as far as 4,000 mm. Such apparatus is notable in particular for its lack of height, as a result of which the operating personnel need work only on one floor. New installation of the apparatus according to the invention thus also results in lower building costs. In addition, the above-defined structure is particularly notable for reliability.

The apparatus may also include a means for entangling the filaments disposed upstream of the wind-up means.

To further reduce spinning problems, a line for feeding the polymer melt from an extruder 10 to the spinnerette may be disposed upstream of the spinnerette. The line includes at least one static mixer 11. This structure advantageously influences the uniformity properties of the spun filament yarns. The static mixers may be disposed within the melt line at one or more locations between extruder and spinnerette. In addition, the static mixers may be disposed directly upstream of a filter packet 12 situated upstream of the spinnerette. It is preferable to ensure that the filter packet achieves very intensive filtration.

If the apparatus of the present invention is used for manufacturing polyester filament yarns at wind-up speeds of up to 10,000 m/min, the yarns obtained as a result exhibit low coefficients of variation, low boiling-water and hot-air shrinkage values and are particularly easily and deeply dyed. The use of the apparatus of the invention for manufacturing polyester yarns at wind-up speeds of 6,000 to 8,000 m/min has proved particularly advantageous. As mentioned earlier, the use of the apparatus has also been found to be particularly advantageous for manufacturing filament yarns from polyethylene terephthalate, polyamide, nylon-6, nylon-6,6, copolymers thereof or mixtures of these polymers. The apparatus is likewise highly suitable in use for manufacturing filament yarns at wind-up speeds of 2,000 to 8,000 m/min with filament linear densities of 0.1 to 5 dtex. Using the apparatus of the invention, it is thus also possible to manufacture microfibers, whose linear densities are within the range of about 0.1 to 1.5 dtex, although it is advisable to reduce the wind-up speed and the machine height as the filament linear density of the filament yarns to be produced decreases.

The apparatus of the invention is also suitable for manufacturing POY yarns. Preference is therefore also given to using the apparatus of the invention for manufacturing polyester yarns by winding up at speeds of 2,000 to 5,000 m/min.

The use of the apparatus will now be more particularly described in the following examples. Table 1 summarizes features of the apparatus according to the invention, the processing conditions maintained and the properties of the yarns obtained.

TABLE 1

| | | A | B | C | D | E | F |
|---|---|---|---|---|---|---|---|
| Polymer | | PET | PET | PET | PET | PET | PET |
| Relative viscosity | | 1.640 | 1.640 | 1.638 | 1.636 | 1.639 | 1.633 |
| Moisture content of granules | [$10^{-3}$% H2O] | 50 | 5 | 50 | 13 | 6 | 5 |
| Dryer temperature | [°C.] | 150 | 150 | 150 | 150 | 170 | 150 |
| Moisture content of granules after drying | [$10^{-3}$% H2O] | 4 | 3–4 | 3–4 | 4 | 4 | 4 |
| Relative viscosity | | 1.642 | 1.640 | 1.642 | 1.646 | 1.659 | 1.641 |
| Extruder | | | | | | | |
| Temperature, zone 1 | [°C.] | 305 | 305 | 305 | 300 | 305 | 320 |
| Temperature, zone 2 | [°C.] | 310 | 300 | 305 | 295 | 300 | 315 |
| Temperature, zone 3 | [°C.] | 295 | 290 | 296 | 290 | 292 | 300 |
| Temperature, zone 4 | [°C.] | 290 | 290 | 292 | 290 | 290 | 295 |
| Temperature, head | [°C.] | 290 | 294 | 300 | 290 | 291 | 292 |
| Pressure | [bar] | 140 | 155 | 160 | 130–200 | 180 | 150 |
| Melt temperature, Extruder | [°C.] | 287 | 291 | 292 | 285 | 293 | 298 |
| Spin pack pressure | [bar] | 90 | 185 | 130 | 170 | 205 | 175 |
| Spinnerette | [micron] | 36/200 | 24/250 | 36/200 | 36/y | 24/250 | 24/250 |
| Diameter, spinnerette | [mm] | 80 | 80 | 80 | 80 | 80 | 80 |
| Temperature, spinnerette | [°C.] | 284 | 296 | 301 | 302 | 293 | 294.5 |
| Throughput | [g/min] | 40.7 | 34.8 | 32.6 | 31.2 | 53.6 | 61.2 |
| Relative melt viscosity | | 1.625 | 1.601 | 1.574 | 1.599 | 1.622 | 1.595 |
| Length, cooling retardation | [mm] | 0 | 0 | 50 | 0 | 100 | 50 |
| Porous tube (sieve on perforated metal) | [mesh] | 60 | 60 | 60 | 60 | 60 | 60 |
| Length, | | 1400 | 700 | 500 | 500 | 700 | 800 |

TABLE 1-continued

| | | A | B | C | D | E | F |
|---|---|---|---|---|---|---|---|
| porous tube | [mm] | | | | | | |
| Diameter, porous tube | [mm] | 80 | 80 | 80 | 80 | 80 | 80 |
| Convergence element and spin finisher | | pin 10 mm dia. | pin 10 mm dia. | pin 10 mm dia. | pin 10 mm dia. | pin 10 mm dia. | pin 10 mm dia. |
| Distance spinnerette spin finisher | [mm] | 1995 | 900 | 880 | 920 | 1000 | 1020 |
| Add-on | [%] | 0.42 | 0.60 | 0.66 | 0.70 | 0.50 | 0.50 |
| Pressure, entanglement jet | [bar] | 1.5 | 6 | 4 | 3.5 | 6 | 7.0 |
| Wind-up speed | [m/min] | 3500 | 7000 | 6500 | 6250 | 7000 | 8000 |
| Wind-up tension | [cN] | 20–21 | 13–14 | 14–15 | 18 | 14–16 | 22 |
| Yarn data | | | | | | | |
| Uster CV 100 | [%] | 0.71 | 1.06 | 0.01 | 1.43 | 1.18 | 0.9–1.0 |
| As-spun breaks | [br/t] | — | 18.8 | 5.7 | 9.4 | 7.1 | — |
| Number of filaments | | 36 | 24 | 36 | 36 | 24 | 24 |
| Total linear density | [dtex] | 115.9 | 49.7 | 50.6 | 50.0 | 75.2 | 76.5 |
| Breaking extension | [%] | 102.8 | 31.5 | 36.0 | 36.0 | 37.7 | 23.5 |
| Tenacity | [cN/tex] | 27.3 | 32.0 | 33.5 | 33.8 | 36.9 | 30.0 |
| Boiling-water shrinkage | [%] | 39.4 | 2.6 | 2.8 | 2.8 | 2.5 | 2.5 |
| Hot-air shrinkage | [%] | 42.7 | 3.3 | 3.6 | 3.6 | 3.3 | 3.4 |
| Birefringence | | 0.0544 | 0.114 | 0.115 | | 0.113 | 0.102 |
| Density | [g/cm3] | 1.3485 | 1.339 | 1.387 | 1.384 | 1.401 | 1.383 |
| Entanglement spacing | [cm] | 9.4 | 6.0 | 5.0 | 5.16 | 6.6 | 7.6 |
| Coefficient of Variation | [%] | 52.3 | 64 | 10.5 | 12.6 | 32.0 | 37.0 |
| Uniformity of Dyeability | | 8.5 | 7.7 | 8.0 | 8.0 | 8.0 | |
| Stripiness of the Dyeings | | | 8.0 | 8.3 | 8.0 | 8.0 | 8.0 |
| Specks | | | 6.0 | 6.0 | 6.0 | 6.0 | 6.0 |

Referring to Table 1, in run D, the 36 holes of the spinnerette used each had a Y-profile for a triangular cross-section, corresponding to a diameter of about 250 μm.

The moisture content of the granules was determined by heating a sample to 200° C. in a vacuum and reading off the autogenous vapor pressure. By means of a calibration curve, it is possible to determine the moisture content of the granules.

The relative solution viscosity was determined in a standard Ubbelohde viscometer on a 1% strength solution in n-cresol. The measurement was carried out at 25° C. The quantities measured are, on the one hand, the flow time of the solution and, on the other, the flow time of the solvent within the same viscometer, from which the relative viscosity is calculated as the ratio of the two flow times.

The entanglement jet used was a parallel plate nozzle in which the plate spacing was 1.2 mm and the diameter of the perpendicular air line was 1.1 mm.

The Uster CV 100 values of linear density uniformity were determined with an Uster tester II-C at 20° C. and 65% relative humidity. The test speed was 100 m/min over 2.5 min.

To measure the hot-air shrinkage, hanks are reeled with a yarn length of 10 mm. After one hour's relaxation at 20° C. room temperature and 65% relative humidity, the starting length is determined under a load of 0.5 cN/tex. This is followed by 15 minutes of hot air in an oven at 190° C. After one hour's conditioning at 20° C. and 65% relative humidity, the hank is remeasured. The change in length is expressed relative to the original value.

The entanglement spacing is measured with the Entanglement tester from Rothschild. The test is carried out at 20° C. and 25% relative humidity. In the examined linear density range between 50 and 200 dtex, the pretension is 10 cN and the pin trip level is 20 cN.

The uniformity of dyeability is determined by cleaning hoses knitted from the yarns in a solution consisting of water and detergent at a temperature of 30° to 35°, then pulling the hoses over formers and setting them on a frame in a steamer preheated to 110° C. The residence time is 10 minutes. The dyeing is then carried out in a solution of water, 60% acetic acid and the dye Foron Blue E-BL. The residence time in the dyeing liquor is about 50 minutes at temperature of about 125°. Finally, the hoses are dried and visually assessed according to standardized criteria on a scale from 1 to 10, where 10 denotes very good. The barriness or stripiness of the dyeings is also rated on a scale from 1 to 10, where 10 again denotes a particularly uniform material. Regarding the specks (thick places in the yarn), the rating scale extends from 1 to 6, where 6 denotes complete absence of specks.

As is evident from the preceding table, use of the apparatus according to the present invention results in yarns of very good Uster CV 100 uniformity and good levelness as well as nonbarriness when dyed.

Although the invention has been described in detail, those skilled in the art will be able to contemplate various modifications within the scope of the invention, which is outlined in the following claims.

What is claimed is:

1. An apparatus for melt spinning multifilament yarns from fiber-forming polymers at wind-up speeds of at least 2000 m/min, comprising:

a spinnerette for spinning a plurality of filaments;

a porous tube for solidifying the plurality of filaments, the plurality of filaments passing within said porous tube, said porous tube being located downstream from said spinnerette;

a convergence element for converging the plurality of filaments to yarn, said convergence element being located downstream of said porous tube; and a wind-up means for winding the yarn, said wind-up means winding the plurality of filaments at a speed of at least 2000 m/min, said wind-up means being located downstream from said convergence element; wherein an essentially vertical spinline is disposed at least between said spinnerette and said convergence element, said porous tube being open in a spinning direction and concentric relative to said spinline, air for cooling the filaments being drawn through said porous tube solely by the filaments themselves due to the wind-up speed of at least 2000 m/min to cool and solidify the filaments, wherein a porosity of said porous tube is selected such that the porosity will produce a pressure drop of about 3 to 150 Pa at an air flow rate of 1 m/sec.

2. The apparatus according to claim 1, wherein said spinline is essentially vertical between said spinnerette and said wind-up means.

3. The apparatus according to claim 1, wherein said porous tube has a length of 200 to 1,800 mm.

4. The apparatus according to claim 1, wherein said porous tube comprises an inner cross-section with approximately the same geometrical shape as a cross-section of a filament bundle formed by said plurality of filaments passing within the porous tube.

5. The apparatus according to claim 1, wherein said porous tube comprises a metal sieve.

6. The apparatus according to claim 5, wherein said metal sieve has a tube of perforated metal disposed therein.

7. The apparatus according to claim 6, wherein said metal sieve is a sieve of 60 mesh.

8. The apparatus of claim 1, wherein said porous tube is attached directly to said spinnerette.

9. The apparatus according to claim 1, further comprising means for inhibiting cooling of the filaments, said means for inhibiting being disposed adjacent said spinnerette between said spinnerette and said porous tube.

10. The apparatus according to claim 1, further comprising means for inhibiting cooling of the filaments, said means for inhibiting being a hot stream enveloping the filaments.

11. The apparatus according to claim 9, wherein said means for inhibiting cooling of the filaments is a heated tube, said heated tube being up to 300 mm long.

12. The apparatus according to claim 9 wherein said means for inhibiting cooling of the filaments is an unheated tube, said unheated tube being up to 300 mm long.

13. The apparatus according to claim 1, further comprising means for inhibiting cooling of the filaments, said means being a covering member covering a part of said porous tube.

14. The apparatus according to claim 13, wherein said covering member is situated adjacent said spinnerette and is up to 300 mm long.

15. The apparatus according to claim 13, wherein said covering member is situated at a distance of 200 to 300 mm downstream from said spinnerette.

16. The apparatus according to claim 1, wherein said convergence element is situated at a distance of 400 to 2,200 mm from said spinnerette and at least about 100 mm from said porous tube.

17. The apparatus according to claim 1, wherein said convergence element is a spin finish applicator.

18. The apparatus according to claim 1, wherein said wind-up means is situated about 2,000 to 4,000 mm from said spinnerette.

19. The apparatus according to claim 1, further comprising means for entangling the yarn disposed upstream of said wind-up means, said entangling means being disposed between said convergence element and said wind-up means.

20. The apparatus according to claim 1, further comprising a line for feeding the polymer melt from an extruder to said spinnerette and a static mixer disposed in said line upstream of said spinnerette.

21. The apparatus according to claim 20, wherein a plurality of static mixers are disposed within the line between said extruder and said spinnerette.

22. The apparatus according to claim 21, wherein said static mixers are disposed directly upstream of a filter packet situated upstream of said spinnerette.

23. The apparatus according to claim 10, wherein said airstream is up to 300 mm long.

* * * * *

UNITED STATES PATENT AND TRADEMARK OFFICE

CERTIFICATE OF CORRECTION

PATENT NO. : 5,612,063

DATED : March 18, 1997

INVENTOR(S) : Diederich Schilo and Wolfgang Peschke

It is certified that error appears in the above-indentified patent and that said Letters Patent is hereby corrected as shown below:

Col. 2, line 58, delete "brokenfilament" and insert --broken-filament--; and
line 65, after "medium", insert --,--.
Col. 4, line 47, delete "spinneretres" and insert --spinnerettes--.
Col. 9, line 11, delete "and";
lines 11-15, delete from "air for cooling. . . .solidify the filaments,";
line 35, delete "of" and insert --according to--; and
line 43, delete "stream" and insert --airstream--.

Signed and Sealed this

Twenty-sixth Day of August, 1997

*Attest:*

Bruce Lehman

BRUCE LEHMAN

*Attesting Officer*

*Commissioner of Patents and Trademarks*